US005167360A

United States Patent [19]

Ritter et al.

[11] Patent Number: 5,167,360

[45] Date of Patent: Dec. 1, 1992

[54] METHOD AND APPARATUS FOR GUIDING WIRE SECTIONS THROUGH AN INSULATING BODY OF A COMPONENT

[75] Inventors: Gerhard Ritter; Klaus Ritter, both of Graz, Austria

[73] Assignee: EVG Entwicklungs- und Verwertungs-Ges.m.b.H., Graz, Austria

[21] Appl. No.: 507,245

[22] Filed: Mar. 15, 1990

[30] Foreign Application Priority Data

Mar. 23, 1989 [AT] Austria ..... 692/89

[51] Int. Cl.[5] ..... A43D 61/00

[52] U.S. Cl. ..... 227/69; 227/80

[58] Field of Search ..... 227/67, 68, 69, 70, 227/80, 82, 84, 71; 83/171; 112/222, 224

[56] References Cited

U.S. PATENT DOCUMENTS

| | | | |
|---|---|---|---|
| 2,171,388 | 8/1939 | Berger | 227/80 |
| 3,335,931 | 8/1967 | Omley et al. | 227/71 |
| 4,271,737 | 6/1981 | Steenson et al. | 83/171 |
| 4,506,818 | 3/1985 | Ritter et al. | 227/67 |
| 4,789,091 | 12/1988 | Randolph | 227/67 |

FOREIGN PATENT DOCUMENTS 0372886 11/1983 Austria .

*Primary Examiner*—Douglas D. Watts
*Assistant Examiner*—Allan M. Schrock

[57] ABSTRACT

Process and device for guiding wire sections through an intermittently advanced insulating body, consisting at least partially of non-pliable material, of a component; wherein, between successive advancing steps a channel for receiving the wire is initially formed in the insulating body and only then is the wire advanced by a wire supply guided through the reception channel from one of the two sides of the insulating body.

11 Claims, 1 Drawing Sheet

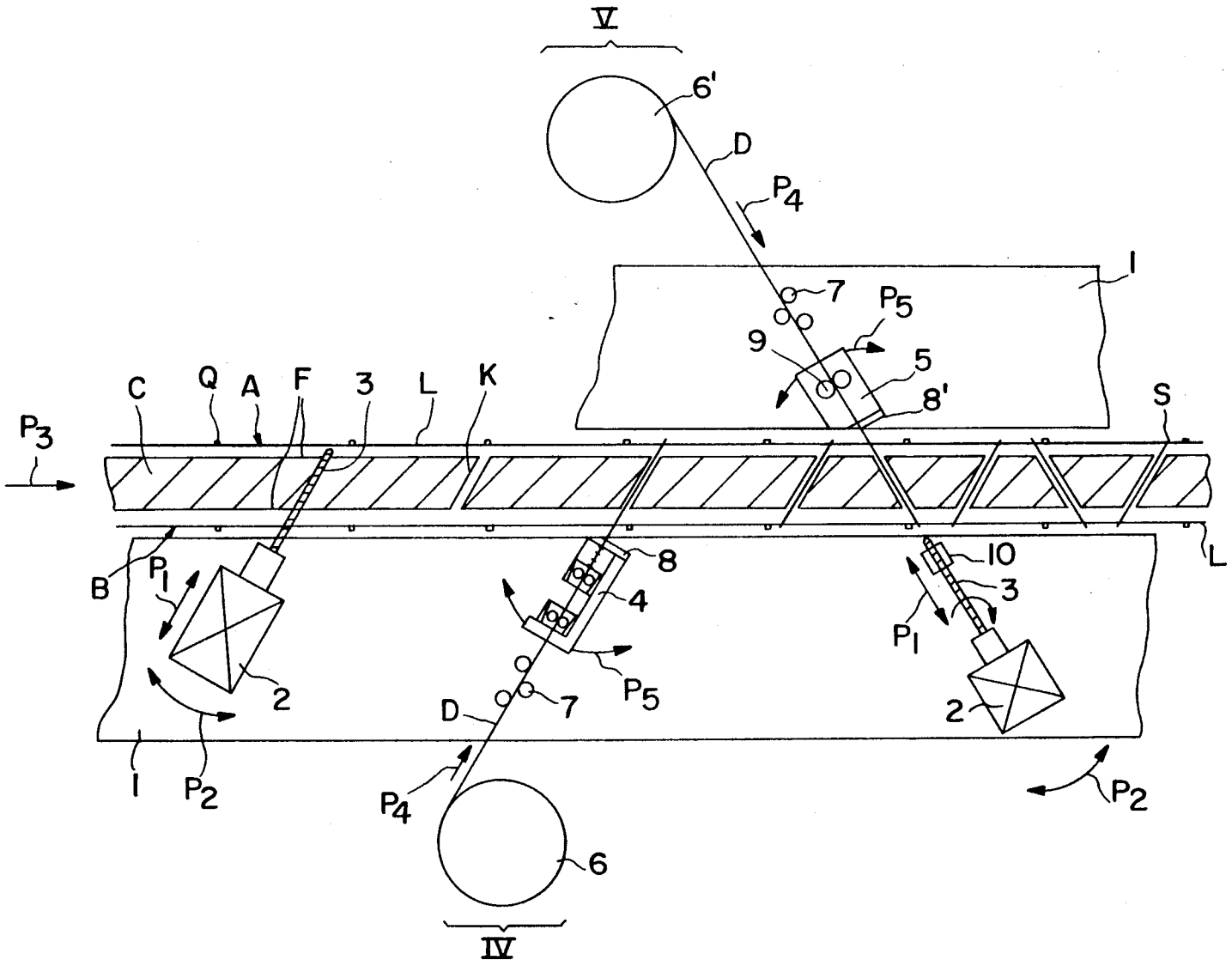
V
6'
D
P4
7
9
P5
5
8'
I
S
L
10
3
P1
2
P2
8
4
P5
7
6
IV
D
P4
K
L
3
F
A
Q
C
B
P1
2
P2
I
P3

METHOD AND APPARATUS FOR GUIDING WIRE SECTIONS THROUGH AN INSULATING BODY OF A COMPONENT

The invention relates to a process and a device for guiding wire sections through an insulating body of a component.

Austrian Patent 374,384 discloses a device for pushing sections of a wire through a solid consisting of pliable material, for example foam or minerally bound wood wool, the penetration process occurring by means of a hollow needle. In this device a wire- advancing clamp can be moved along a slide bar arranged on a support, the hollow needle being mounted on the front of said wire- advancing clamp. Furthermore, in the region of the slide bar there as provided a wire-reversal preventing device and scissors for cutting off the wire section which has been pushed through the solid in each case.

When manufacturing components which as shown in Austrian Patent 372,886 may consist of two parallel, planar lattices, linking wires connecting these lattices and an insulating plate arranged in the intermediate space between the lattices, the linking wires are pushed through the insulating plate by means of the device described above. However, the material of the insulating plate must be pliable so that it does not offer too much resistance to the linking wire and bend it.

According to an advantageous development of the device according to Austrian Patent 374,384, stiffening of the hollow needle is provided in that the hollow needle is stiffened by means of longitudinal ribs which are sharpened towards the outside in a knife-like manner and come to a point at their front ends. However many insulating plates cannot be penetrated using this device. These are for example insulating plates with hard cover surfaces and massive insulating plates consisting of hardwoods or of hard plastics, such as for example polyurethane. But even insulating plates of partially pliable material, such as for example jute, straw or bamboo netting cause problems when using the known device because the hard fibers of these insulating plates do not yield laterally in all cases.

The present invention is aimed at eliminating this deficiency and providing a process as well as a device with which even insulating plates of stiffer and hard material can be satisfactorily penetrated by linking wires of lattices. The process according to the invention for guiding wire sections through an intermittently advanced insulating body, consisting at least partially of non-pliable material, of a component is characterized by the combination of features that between successive advancing steps a tool for forming a channel to receive the wire is initially driven through the insulating body, the tool is then withdrawn and only then is the wire advanced by a wire supply guided through the reception channel from one of the two sides of the insulating body.

By means of this procedure it is possible in an advantageous manner for linking wires to be reliably passed through insulating materials of various kinds without any mentionable expenditure of force.

A device intended for carrying out the process according to the invention, in which device a wire-feeding apparatus directed towards the advancing path is provided on a base frame arranged by the advancing path of the insulating body, is distinguished by the fact that on the base frame in addition to the wire-feeding apparatus there is arranged at least one apparatus which is separated from the latter and with which a channel, serving to receive the wire section, can be formed in the insulating body.

According to a preferred embodiment of the invention, the apparatus for forming the wire reception channel and the wire-feeding apparatus are arranged in alignment on opposite sides of the advancing path of the insulating body. Alternatively, the apparatus for forming the wire reception channel can be arranged on the same side of the insulating body and at the same angle as the wire- feeding apparatus and the apparatus for forming the wire reception channel can be arranged ahead of the wire-feeding apparatus in the advancing direction of the insulating body.

According to a further feature of the invention, the apparatus for forming of the wire reception channel is mounted for slideably movement longitudinally of the base frame and may be pivoted in synchronism with the wire- feeding device.

In a structurally simply manner the apparatus for forming of the wire reception channel may comprise a boring (drilling) or milling apparatus with a rapidly rotating tool. Alternatively, the apparatus for forming the wire reception channel can be formed by a piercing apparatus with a non-rotating tool, preferably it being possible to heat up the tip of the tool.

In an advantageous embodiment of the invention, a plurality of apparatuses for forming the wire reception channel can be provided in a horizontal and/or vertical direction.

The sole figure represents various embodiments of the invention.

Further features of the invention are explained below with reference to an exemplary embodiment and the drawing, in which a longitudinal section of variants of the device according to the invention is represented, not all of which, however, have to be used at the same time.

The individual fixtures of the apparatus in accordance with the invention may be mounted on a base frame 1 which is connected to equipment for manufacturing the components which are intermittently advanced along the base frame 1 in a manner well known in the art. The components may consist of two lattices A and B arranged on opposite sides of an insulating plate C, formed of longitudinal wires L and transverse wires Q which extend perpendicularly of each other and may be soldered to one another, the lattices A, B being connected by means of linking wires S to form a rigid unit. The linking wires S are guided through the insulating plate C at different inclinations and are soldered to the nearest wire L, Q of the lattices A, B.

The insulating plate C may consist of various materials and may be constructed in a variety of ways. The insulating plate C may be a unitary structure consisting, for example, of hard woods or hard plastics such as, for example, polyurethane and the like. Furthermore, the insulating plate C may be a layered structure comprising a core of a loose soft filler such as, for example, foam or minerally bound wood wool (excelsior), and relatively hard cover layers F bordering on the lattices A and B, it being possible for said cover layers F to consist, for example, of wood, jute, reed or bamboo netting.

A boring (drilling) fixture 2 provided with a rapidly rotating boring tool 3 is mounted on the base frame 1 for longitudinal and pivotal movement in the direction of arrows $P_1$ and $P_2$, respectively. The boring fixture 2 and the boring tool 3 are constructed in such a way that they may bore a wire receiving channel K into the insulating plate C, into which wire receiving channel a wire section forming the linking wire S may be inserted, in a subsequent workstep, by means of a wire-feeding fixture 4 or 5.

For purposes of forming the receiving channel K, either the entire boring fixture 2 or the boring tool 3 only may be advanced in the direction of the arrow $P_1$, and may thereafter be withdrawn to clear the receiving channel K for insertion of the linking wire S. The boring fixture 2 is arranged to be pivotable in the direction of arrow $P_2$ to allow the linking wires S to extend at any desired angle between the lattices A and B. In order to facilitate penetration into insulating plates C made of plastic materials, the tip of the boring tool 3 may be heated by heating means well-known in the art and schematically indicated at 10.

As schematically depicted at IV, the wire-feeding fixture 4 may be mounted on the same side of, and at the same angle relative to, the insulating plate C as the boring fixture 2; but in the direction of production or conventionally effected movement as schematically indicated by the arrow $P_3$ it is mounted behind the boring fixture, or as schematically shown at V in connection with wire-feeding fixture 5, it may be mounted on the side of the insulating plate C opposite the boring fixture 2 but in axial alignment with its boring tool 3.

The wire-feeding fixture 4 is constructed in a manner well known in the art. The wire D as drawn from a supply reel 6 is initially directed through guide rollers 7 and is thereafter inserted in the direction of arrow $P_4$ into the receiving channel K, by the wire-feeding fixture 4, is soldered to the nearest wire L or Q of the lattices A and B and is cut to the desired length by means of shears 8. The wire-feeding fixture essentially comprises an advancing clamp or chuck which may be moved forward and backward, a reverse movement movement prevention device, and a hollow needle or sleeve through which the wire section may be guided. The wire-feeding fixture 4 may be mounted on the base frame 1 to be pivotable in the direction of the arrow $P_5$ in order to permit any desired angles at which the linking wires S may extend between the longitudinal wires L of the lattices A, B. Pivoting of the wire-feeding fixture 4 in the direction of the arrow $P_5$ may occur simultaneously and concomitantly with pivotal movement of the boring fixture 2 in the direction of the arrow $P_2$.

The spacing of the wire-feeding fixture 4 from the boring fixture 2 and the intermittent advance stroke of lattices A, B and insulating plate C in the manufacturing equipment are matched to each other in such a way that after each advancing step the feed position for the linking wire corresponds exactly with the receiving channel K prepared by the boring fixture 2.

Conventional wire-feeding fixtures provided with a hollow needle or sleeve having sharpened blades extending along their length may be expediently used where the core of an insulating plate C is dimensionally unstable or where the receiving channel K cannot be maintained. In such instances there would be a risk of the wire section bending, deviating from its designed path and failing to meet the exit of the receiving channel K on the opposite side of the insulating place C.

As schematically shown at V a simple wire-feeding fixture 5 may draw wire D' from a supply reel 6' by means of advancing wheels 9 and through suitable guide rollers 7' insert the wire D' in the direction of the arrow $P_4$ into the prepared receiving channel K. In a manner similar to that described in connection with the wire-feeding fixture 4 the wire are cut off to the desired length of the linking wires S by means of shears 8'. The wire-feeding fixture 5 is arranged on the base frame 1 also to be pivotable in the direction of the arrow $P_5$ in order to permit various angular positions of the linking wires in the completed component.

In the exemplary embodiment V the wire-feeding apparatus 5 is not located on the same side of the lattice tracks as the boring apparatus 2 but rather on the opposite side of the advancing path and is arranged there in such a way that the advancing direction $P_1$ of the boring tool 3 is exactly aligned with the advancing direction $P_4$ of the wire D. This arrangement has the advantage that after completion of the reception channel K and withdrawal of the boring tool from the reception channel K the wire section can be immediately inserted from the other side of the lattice tracks without an intermediate step, i.e. without moving the insulating plate C. In this way, positioning errors caused by the intermediate step, a maladjustment and a possible partial destruction of the prepared reception channel K due to mechanical shocks to the insulating plate during the intermediate step are avoided.

In accordance with the invention other tools may also be used to construct permanent reception channels K for linking wires S. For example, a piercing tool which is longitudinally movable in the direction of the arrow $P_1$, e.g. a striking bolt with correspondingly shaped tip can be used, which if appropriate can be warmed up in order to make penetration of the plastic insulating plate easier.

By providing a plurality of boring apparatuses 2 and wire-feeding apparatuses 4 and 5 in the production direction $P_3$, the operational speed of the device can be correspondingly increased.

By using the device according to the invention in equipment for manufacturing components, for example of a kind well known in the art, these devices may be arranged in multiples on top of one another in a vertical direction in stands which are pivotable in common in the direction of arrows $P_2$ and $P_5$ in order simultaneously to form a plurality of wire receiving channels in an insulating plate.

It is within the scope of this invention the linking wires may be formed from pre-cut wire sections which may individually be fed from a supply by a wire-feeding fixture which would not need shears.

We claim:

1. Apparatus for inserting wire sections into a sheet member comprising first and second opposite surfaces, said apparatus comprising:

means extending in a predetermined direction for defining a path of movement;

means for intermittently advancing said sheet member along said path;

means movable alternatingly with said advancing means between a first position in which said movable means penetrates through said sheet member and a second position in which said movable means is removed from said sheet member for forming a channel extending therethrough;

means for thereafter feeding a wire section of predetermined length into said channel from a substantially endless supply thereof; and means for thereafter severing said wire section from said endless supply.

2. The apparatus of claim 1, wherein said means for forming said channel and said means for feeding said wire are positioned adjacent said first and second surfaces respectively.

3. The apparatus of claim 2, wherein said means for forming said channel and said means for feeding said wire are coaxially aligned.

4. The apparatus of claim 1, wherein said means for forming said channel is positioned adjacent the same surface as said means for feeding said wire.

5. The apparatus of claim 4, wherein said advancing means advances said sheet member in increments of substantially uniform distance and wherein said means for forming said channel and said means for feeding said wire are spaced from each other substantially by said uniform distance.

6. The apparatus of claim 5, wherein said means for forming said channel is movable along its longitudinal axis relative to said path and is mounted for pivotal movement about an axis parallel to said sheet member.

7. The apparatus of claim 6, wherein said means for forming said channel and said means for feeding said wire mounted for synchronous pivotal movement.

8. The apparatus of claim 7, wherein said means for forming said channel and said means for feeding said wire are pivotable in substantially the same direction.

9. The apparatus of claim 1, wherein said means for forming said channel comprises rotary drilling and milling means.

10. The apparatus of claim 1, wherein said means for forming said channel comprises a non-rotary piercing means.

11. The apparatus of claim 10, wherein said piercing means comprises means for heating the tip of said piercing means.

* * * * *